US006759377B2

(12) United States Patent
Hackenthal et al.

(10) Patent No.: US 6,759,377 B2
(45) Date of Patent: Jul. 6, 2004

(54) DETERGENT FOR VITROCERAMIC SURFACES

(75) Inventors: Marion Hackenthal, Ludwigshafen (DE); Alexandra Hary, Ludwigshafen (DE); Mike Kosub, Bruchsal (DE); Edgar Endlein, Wrestedt (DE)

(73) Assignee: Reckitt Benckiser N.V., Hoofddorp (NL)

( * ) Notice: Subject to any disclaimer, the term of this patent is extended or adjusted under 35 U.S.C. 154(b) by 0 days.

(21) Appl. No.: 10/058,535

(22) Filed: Jan. 28, 2002

(65) Prior Publication Data

US 2002/0137647 A1 Sep. 26, 2002

Related U.S. Application Data

(63) Continuation of application No. PCT/EP00/07157, filed on Jul. 26, 2000.

(30) Foreign Application Priority Data

Jul. 29, 1999 (DE) ..... 199 35 083

(51) Int. Cl.[7] ..... C11D 3/14; C11D 3/37; C11D 7/22; B08B 3/04

(52) U.S. Cl. ..... 510/197; 510/180; 510/219; 510/236; 510/238; 510/239; 510/240; 510/243; 510/395; 134/25.2; 134/25.3; 134/39; 134/40; 134/42

(58) Field of Search ..... 510/180, 197, 510/219, 236, 238, 239, 240, 243, 395; 134/25.2, 25.3, 39, 40, 42

(56) References Cited

U.S. PATENT DOCUMENTS

| | | | | | |
|---|---|---|---|---|---|
| 3,645,904 | A | * | 2/1972 | Beach | 252/89 |
| 4,921,630 | A | | 5/1990 | Bhatia | |
| 5,849,105 | A | * | 12/1998 | Massaux et al. | 134/29 |
| 2002/0137647 | A1 | * | 9/2002 | Hackenthal et al. | 510/180 |

FOREIGN PATENT DOCUMENTS

| | | | | | |
|---|---|---|---|---|---|
| DE | 1669094 | | * | 5/1971 | C09G/1/02 |
| EP | 0 011 984 | A1 | | 6/1980 | |
| EP | 0030986 | | * | 7/1981 | C11D/3/14 |
| EP | 0 206 534 | A1 | | 12/1986 | |
| EP | 0216416 | | * | 4/1987 | C11D/3/14 |
| EP | 0 286 167 | A3 | | 10/1988 | |
| EP | 0335471 | | * | 10/1989 | C11D/3/43 |
| EP | 0 388 629 | A1 | | 9/1990 | |
| EP | WO 97/47724 | | * | 12/1997 | C11D/17/00 |
| EP | WO 01/09279 | | * | 2/2001 | C11D/17/00 |
| WO | WO 97/32966 | A1 | | 9/1997 | |

* cited by examiner

*Primary Examiner*—Brian P. Mruk
(74) *Attorney, Agent, or Firm*—Akin Gump Strauss Hauer & Feld, L.L.P.

(57) ABSTRACT

A detergent for glass-ceramic surfaces has a certain abrasive agent content and a pH value lower than about 6. The abrasive agent contains particles of an organic material, preferably in an amount of at least about 20% of the abrasive agent, and more preferably substantially the entire abrasive agent. The organic material may be a polyolefin or polyurethane, for example, and may be predominantly present as particles with a particle size in the range of about 10 to 1000 $\mu$m. The abrasive agent may also include mineral particles.

16 Claims, No Drawings

DETERGENT FOR VITROCERAMIC SURFACES

CROSS-REFERENCE TO RELATED APPLICATIONS

This application is a continuation of International Application No. PCT/EP00/07157, filed Jul. 26, 2000, the disclosure of which is incorporated herein by reference.

BACKGROUND OF THE INVENTION

The invention is directed to a cleaning agent for glass ceramic surfaces containing a quantity of abrasive and having a pH value of less than 6.

Glass ceramic materials are polycrystalline solids made by the ceramification, i.e., controlled devitrification, of glasses. Glass ceramic products are shaped by glass technology processes and after heat treatment possess the properties and processability of special ceramics, in particular a very high capacity to withstand temperature fluctuations. This latter property makes them particularly suitable for cooker hob and crockery applications, for which they have been used to an increasing degree in recent years.

Especially in cooker hob applications, glass ceramic is exposed to a specific type of dirt which includes, in addition to proteins, starch and fat (e.g., cooking sauce, tomato puree, milk, noodles, rice or potatoes), and calcium stains, especially in regions where the water is particularly hard.

The usual approach to removing stains of this type is to use acid cleansers containing abrasives, such as mixtures of clay earth of differing particle sizes as described in European published patent application EP 0 388 629 A1, for example. All commercially available cleaning agents for glass ceramic surfaces contain abrasives in the form of water-insoluble minerals with a typical Mohs hardness of between 7 and 9. Although very effective, these abrasives attack the surfaces to be cleaned, in many instances because of their hardness. This quite rapidly leads to unsightly, i.e., scratched, surfaces, especially in the case of glass ceramic.

Plastics have long been used as abrasive agents in body cleansing agents, especially in cleansers for the hands, in order to provide a gentler, more skin-friendly alternative to the harsh scouring effect of mineral abrasives.

U.S. Pat. No. 3,645,904 proposes the use of synthetic resin particles for skin cleaning preparations. Mention is made, among other things, of polyolefins, which are relatively soft, in particular polyethylene, polypropylene and polystyrene. The particles have a diameter of 74 to 420 $\mu$m and the quantity used in the product is 3 to 15% by weight.

German Patent DE 16 69 094 D2 discloses cleaning agents with 100 parts of liquid soap and 10 to 900 parts of polyethylene-abrasive agent with a particle size of 10 to 1000 $\mu$m. The compositions are described as being suitable for cleaning hands and for gentle cleaning of hard surfaces, in particular lacquered metal.

Japanese published examined application 06-033414 B2 discloses the use of 5 to 30% by weight of organic abrasive with a particle size of from 10 to 500 $\mu$m in body washes and for removing rust or carbon deposits from machinery. Polyurethane and polyolefins are among other abrasives described. The minimum content of abrasive needed to produce an effective action is 5% according to this prior art document.

Abrasives made from plastics are also mentioned in connection with domestic cleaning agents, usually to provide a gentle cleaning action on sensitive surfaces.

European published patent application EP 0 011 984 A1 discloses liquid alkaline cleansing agents containing water-insoluble multivalent metal soaps as a means of imparting thixotropic qualities and stability to the formulations. Ground polymer materials, such as ground polyurethane foam, are cited as abrasives. However, mineral abrasives are preferred.

European published patent application EP 0 030 986 A1 discloses a liquid washing-up detergent, having a pH value of from 6 to 11 and containing surfactants, builders and 3 to 20% of abrasives with a Mohs hardness of from 2 to 7 and a particle size of from 1 to 150 $\mu$m. Both inorganic and plastic materials, e.g., polystyrene and polyacrylates, are disclosed as abrasives. However, no specific example is given for the use of plastic abrasives.

European published patent application EP 0 206 534 A1 discloses liquid alkaline cleaning agents which incorporate a thickening system consisting of an inorganic colloid and an anionic fatty acid surfactant. Inorganic materials are specifically disclosed as abrasives, although organic materials are briefly mentioned.

European published patent application EP 0 216 416 A2 discloses a liquid cleaning agent containing 1 to 50% by weight of a water-soluble mild abrasive, mention being made of both inorganic and organic materials. If using organic materials, the preferred range is 5 to 15% by weight. The preferred abrasive, and in fact the only one documented in the examples, is calcium carbonate.

European published patent application EP 0 335 471 A1 discloses a cream cleansing agent containing 10 to 60% by weight of an abrasive agent. Inorganic and organic abrasives are mentioned and, in the case of applications using organic abrasive, particular mention is made of the fact that the latter reduces scratching on sensitive surfaces, for example made from plastic. The only abrasive mentioned and the one documented in the examples, however, is calcite.

International application publication WO97/47724 A1 discloses a liquid cleaning agent in liquid crystal form, which contains up to 20% by weight of abrasive selected from the group consisting of hydrated silica, calcite and polyethylene particles with a particle size of 200 to 500 $\mu$m. No reasons are given as to why this abrasive should be selected.

Although it is evident from the state of the art that abrasives made from plastics may be used if a gentler scouring action than that obtained with mineral abrasives is desired, e.g., to protect sensitive surfaces, no details are given as to the cleansing effect of abrasives of this type, especially in comparison with mineral abrasives. Moreover, no acid cleaning agent is known which contains an abrasive made from plastic.

BRIEF SUMMARY OF THE INVENTION

Accordingly, an underlying objective of the invention is to propose a cleaning agent of the generic type with an improved cleaning action. This objective is achieved by the invention in the form of a cleaning agent for glass ceramic surfaces, containing a quantity of abrasive agent and having a pH value of less than about 6, in which the abrasive agent comprises particles of an organic material. This being the case, the abrasive preferably comprises at least about 20% by weight, more preferably substantially entirely, organic material.

The content of abrasive agent in the cleaning agent proposed by the invention is preferably about 10% by weight or less, more preferably about 5% by weight or less.

Preferred organic polymers are polyolefins, such as polyethylene, or polyurethane. Preferably, the organic material is present in a particle size (diameter or largest dimension) within a range of about 10 to 1000 μm, more preferably about 100 to 200 μm.

The invention is additionally directed to the use of an organic material, alone or in combination with a mineral compound, as an abrasive in a cleaning agent for glass ceramic surfaces in order to improve the cleaning action.

DETAILED DESCRIPTION OF THE INVENTION

Totally surprisingly, it has been found that acid cleaning agents exhibit a superior cleaning action on glass ceramic surfaces, such as glass ceramic cooker hobs, if the usual mineral abrasive is partially or totally replaced by an abrasive made from organic material. Even more surprising was the cleaning performance, given that, even with a low content of abrasives of less than about 10% by weight, the cleaning action was superior to that of standard commercial cleaning agents containing mineral abrasives in a quantity of, for example, 26% by weight. As an additional advantage, as expected, the lower hardness and larger particle size of the organic abrasive proved to be much kinder to surfaces.

The organic material, which partially or entirely comprises the abrasive agent, may be varied in nature. Consideration may be given in particular to synthetic organic polymers, for example polyurethane, polyethylene, polypropylene, polyvinyl chloride, polyester, polystyrene, ABS resin, urea resin, polycarbonates, polyamides, phenolic resins, and epoxy resins. Of these, polyurethane and polyethylene are more particularly preferred. In addition, however, organic materials of natural origin may be considered, such as rice husks, ground corn cobs, ground walnut shells, etc. The particle size of the organic material is preferably about 100 to 200 μm, but may also be smaller (down to 10 μm) or larger (up to 1000 μm).

If the organic material is used in conjunction with inorganic abrasives (the ratio in such a mixture not being particularly critical, although it is preferable to use a proportion of at least about 20% by weight of organic material), the inorganic abrasives may be selected from the whole range of mineral abrasives mentioned above, such as aluminium oxide, silicon dioxide, sillitin, boehmite, hydrargillite, aluminium silicate, kaolinite, etc.

Other important functional ingredients of the cleaning agent proposed by the invention are surfactants. Of these, essentially all known surfactants which are compatible with an acid medium may be considered, i.e., non-ionic surfactants, such as the entire range of fatty alcohol ethoxylates or alkyl ethoxylates; amphoteric surfactants, such as amido-betaines, betaines, alkylamino-carboxylates, imino-diproprionates, etc.; anionic surfactants, such as alkyl sulphates, alkyl ether sulphates, sulpho-succinates, etc.; and cationic surfactants, such as protonated alkyl amines, ethoxylated alkyl amines, etc.

Another important ingredient is acid or an acid mixture, preferably selected from organic acids, such as citric acid, amido-sulphuric acid, glycolic acid, lactic acid, etc. The preferred pH value for the cleaning agent is about 2 to 5, more preferably about 2 to 3.

Other ingredients which may be incorporated in the cleaning agent proposed by the invention include solvents, such as isopropyl alcohol, polyethylene glycol, N-methyl-2-pyrrolidone, etc.; thickening agents, such as xanthan gum or organic-modified silicates (e.g., OPTIGEL®WX); care-enhancing additives, such as polydimethyl siloxane (with a viscosity of about 100 mPas to 12,500 mPas), organo modified silicones, amino-functionalized silicones, silicon quats, polyvinyl pyrrolidones, etc; fragrances, dyes; preservatives, etc.

Further details of the tests that were conducted are set out in the example below.

EXAMPLE

Test Method

The method used to test the cleaning action of cleaning agents for glass ceramic surfaces is based on typical household dirtying and simulated spattering of foodstuffs during preparation. The temperature of the glass ceramic surface in the vicinity of the heated area is typically about 200° C. The heated region itself, which reaches temperatures of up to about 500° C., is not usually exposed to spattering. Pollutants which do come into contact with these regions heated to high temperatures carbonize immediately, however, and are therefore not suitable as a means of providing reproducible substrates for meaningful tests.

a. Preparation of the Evaluation a. 1 Preliminary Cleaning of the Surface

First, the glass ceramic surface (25×25 cm tiles of glass ceramic) is cleaned using an alkaline cleaning agent (pH 10) and a liquid washing detergent. The glass ceramic tiles used are soaked in a hot solution of liquid washing detergent and lime scale remover for approximately 2 hours. This is followed by two cleaning cycles in a laboratory dish washer using a chlorine-containing dish washing agent and de-ionized water (duration of a cycle approximately 45 minutes).

a2. Producing the Substrate

The dimensions of the soiled region are 25×10 cm. The dirt is applied with a standard blade. The soiled glass ceramic tiles are exposed to a temperature of about 200° C. in a preheated oven, the dwell time in the oven being varied depending on the type of dirt (cooking sauce: 15 min.; tomato puree: 12 min.; tinned milk: 7 min.; lime scale/starch: 30 min.).

b. Evaluation of the Cleaning Action

An automatic wiper is used for cleaning purposes, e.g., made by Erichsen Company, Hemer, Germany. This automatic wiper operates with a moist sponge applied at 300 g/3600 $mm^2$ (sponge surface). The automatic wiper wipes at a speed of 37 wiping motions per minute.

The experiment is conducted using a standard, commercially available cleaning agent for glass ceramic surfaces (A), as well as two different formulations of a cleaning agent as proposed by the invention (B) and (C).

In a preliminary test, it is initially established which of the three formulations is the most effective. The test is continued with this formulation until approximately 75% of the dirt has been removed. The time needed to achieve this also determines the test duration for the other formulations. Every test procedure is repeated at least 5 times.

When the experiments on a tile are finished, the tile is rinsed with tap water and then with de-ionized water, in order to remove any spots of water. The tiles are stored vertically at room temperature to dry.

The tiles are evaluated by at least 3 trained persons, each independently of the others. The tiles are marked on a scale of 0 (no cleaning action) to 10 (totally clean).

Formulations

| Ingredients | A | B | C |
|---|---|---|---|
| Alkyl sulphonate | 1.8 | 1.8 | 1.8 |
| Ethoxylated alcohol | 3 | 3 | 3 |
| Amido-sulphuric acid | 2 | 2 | 2 |
| Citric acid | 0.25 | 0.25 | 0.25 |
| Silicone oil | 2.5 | 2.5 | 2.5 |
| Thickening agent (xanthan gum) | 0.5 | 0.5 | 0.5 |
| NaOH | to adjust to a pH of 3 | | |
| Quartz | — | — | 4 |
| Aluminum oxide, 3 $\mu$m | 26 | — | — |
| Polyurethane, 200 $\mu$m | — | 5 | 5 |
| Others (fragrances, pigments, preservatives) | 0.46 | 0.46 | 0.46 |
| Water | | Remainder | |

Test results

| Pollutants | A | B | C |
|---|---|---|---|
| Cooking sauce | 5 | 9 | 9 |
| Tomato puree | 6 | 9 | 8 |
| Tinned milk | 3 | 8 | 8 |
| Lime scale/starch | 6 | 8 | 8 |

Cleaning agent B produced the best test results, despite the significantly lower content of abrasive agent than is customary with mineral abrasives, and is the one which contains no mineral abrasives at all. Approximately equal value results are obtained with a mixture of quartz and polyurethane, while the cleaning results for the standard cleaning agent containing aluminum oxide (3 $\mu$m) as an abrasive are significantly poorer, despite the high proportion of 26% by weight.

The features of the invention disclosed in the description given above as well as in the claims may be construed as essential to implementing the invention in its different embodiments, either alone or in any combination.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A cooker hob glass ceramic surface cleaning agent, comprising a quantity of abrasive agent, a thickening agent, and a pH value of about 2 to 3, wherein the abrasive agent comprises particles of an organic material.

2. The cleaning agent as claimed in claim 1, wherein the abrasive agent comprises at least 20% by weight organic material.

3. The cleaning agent as claimed in claim 2, wherein the abrasive agent consists essentially of organic material.

4. The cleaning agent as claimed in claim 1, wherein the abrasive agent content is not more than 10% by weight of the cleaning agent.

5. The cleaning agent as claimed in claim 4, wherein the abrasive agent content is not more than 5% by weight of the cleaning agent.

6. The cleaning agent as claimed in claim 1, wherein the abrasive agent comprises particles selected from the group consisting of polyolefin and polyurethane.

7. The cleaning agent as claimed in claim 6, wherein the particles comprise polyethylene.

8. The cleaning agent as claimed in claim 1, wherein the organic material is present as particles in a size range of about 10 to 1000 $\mu$m.

9. The cleaning agent as claimed in claim 8, wherein the organic material is present as particles in a size range of about 100 to 200 $\mu$m.

10. The cleaning agent as claimed in claim 1, wherein the abrasive agent also includes mineral particles.

11. A method of cleaning a glass ceramic surface of a cooker hob, comprising applying to the surface the cleaning agent according to claim 1.

12. The cleaning agent according to claim 1, further comprising: a surfactant selected from the group consisting of a non-ionic surfactant, an amphoteric surfactant, an anionic surfactant, and a cationic surfactant; and an acid or acid mixture.

13. The cleaning agent according to claim 12, further comprising a constituent selected from the group consisting of a solvent, a fragrance, a dye, a preservative, and a care-enhancing additive selected from the group consisting of polydimethyl siloxane, an organo-modified silicone, an amino-functionalized silicone, a silicon quat and a polyvinylpyrrolidone.

14. The cleaning agent according to claim 12, wherein the abrasive agent comprises a mixture of particulate organic material having a particle size of about 10 to 1000 $\mu$m and an inorganic abrasive.

15. The cleaning agent according to claim 14, wherein the mixture comprises at least 20% by weight of the organic material and a balance to 100% by weight of the inorganic abrasive.

16. The cleaning agent according to claim 12, further comprising a care-enhancing additive selected from the group consisting of polydimethyl siloxane, an organo-modified silicone, an amino-functionalized silicone, a silicon quat and a polyvinylpyrrolidone.

* * * * *